US006122771A

United States Patent [19]

Cook et al.

[11] Patent Number: 6,122,771

[45] Date of Patent: Sep. 26, 2000

[54] INTERCHANGEABLE BIB/APRON

[76] Inventors: Marjorie Cook, 2900 Vanhoy Rd., Yadkinville, N.C. 27055; Kimberly Babcock, 264 Alexandra Rd., Mount Pleasant, S.C. 29464

[21] Appl. No.: 09/020,446

[22] Filed: Feb. 9, 1998

[51] Int. Cl.[7] ..... A41B 13/00; A41B 13/10

[52] U.S. Cl. ..... 2/48; 2/49.1; 2/52

[58] Field of Search ..... 2/48, 49.1, 49.2, 2/49.4, 49.5, 50, 51, 52, 46, 47, 60, 468, 135, 136, 145, 144, 207, 208; D2/860, 861, 605, 609

[56] References Cited

U.S. PATENT DOCUMENTS

| | | |
|---|---|---|
| 574,921 | 1/1897 | Lloyd . |
| 969,491 | 9/1910 | Payne . |
| 1,391,121 | 9/1921 | Keppel . |
| 2,250,887 | 7/1941 | Brown . |
| 2,425,635 | 8/1947 | Nitzberg . |
| 2,544,487 | 3/1951 | Caluthis . |
| 2,648,845 | 8/1953 | Berman . |
| 3,024,466 | 3/1962 | Agostini . |
| 3,042,930 | 7/1962 | Martinez . |
| 3,540,060 | 11/1970 | Brown . |
| 4,569,086 | 2/1986 | Takefman . |
| 4,712,251 | 12/1987 | Cobble . |
| 4,719,650 | 1/1988 | Milloy . |
| 4,862,518 | 9/1989 | Williams et al. . |

*Primary Examiner*—John J. Calvert
*Assistant Examiner*—Shirra L. Jenkins

[57] ABSTRACT

An interchangeable bib having a triangularly shaped neck engaging section, a body encompassing section and a variety of ways for securing the body encompassing section to the neck engaging section. The two upper ends of a downwardly pointing isosceles triangle are joinable about the neck of the wearer to hold the bib in place, and the body encompassing section can be frequently changed to provide a clean section or a differently decorated section as desired.

5 Claims, 1 Drawing Sheet

INTERCHANGEABLE BIB/APRON

BACKGROUND OF THE INVENTION

1. Field of the Invention

The present invention relates to bibs and aprons and more particularly, to an interchangeable bib or apron having a neck engaging section and an interchangeable body encompassing section.

2. Description of the Prior Art

A number of approaches have been taken for providing a protective bib-like article, particularly for infants, to be worn over clothing to protect the clothing from food spills, dribbles and the like. Such bibs are usually formed of an absorbent material, typically terrycloth or the like and are made in various shapes and sizes with means for attaching the bib about the neck of the child. Usually, a pair of cords or other mate enclosures are involved. With an improper fit about the neck, liquid or food can travel onto the baby's clothes through the neck gap. Furthermore, upon receipt of large deposits of food or material thereon, such bibs tend to soak through, staining the underlying clothing due to their absorbent nature. One prior art form of cloth bib is that which is formed of an absorbent material having a thin waterproof backing. This backing will prevent the seepage experienced by all-cloth bibs; however, it still is a "one use" bib requiring laundering after each use.

Another alternative to absorbent bibs is a bib constructed solely of a water resistant material which normally relies on a pocket formed into the bottom edge of the bib to catch the food or liquid. Because of the material from which it is formed, it typically is bulky, does not properly drape over the clothing, and cannot be placed snugly about the neck without constricting the child.

In varying the appearance of conventional bibs, it is necessary to substitute an entirely new bib with a different color or design in order to achieve that purpose. The capacity to so decorate is expensive in that a plurality of bibs must be on hand to provide the requisite decorative effect.

Aprons conventionally worn by cooks or waiters share a similarity with bibs in that they protect the wearer from food stains and the like and they can, on necessary occasions, provide a decorative effect.

Thus, there has been identified a clear and urgent need for a versatile bib or apron that can be inexpensively maintained and selectively altered for decorative effect. It is to this need that the present invention is directed.

SUMMARY OF THE INVENTION

The present invention is for an interchangeable bib or apron which includes a neck engaging section, a body encompassing section secured to the neck engaging section, and appropriate securement means joining the neck engaging section to the body encompassing section. The neck engaging section is triangularly configured with two upper ends and a lower end. The two upper ends are joinable upon encircling the neck of a wearer to hold the bib in place and the securement means joins the body encompassing section to the neck engaging section by any number of convenient joining elements.

From the foregoing summary of the present invention, it can be seen that a primary objective is to provide an interchangeable bib or apron which includes all of the advantages of prior art devices and more and none of the disadvantages.

Another objective of the present invention is to provide a simplistic, inexpensive and attractive interchangeable bib or apron that can be efficiently changed in appearance for decorative reasons or to replace a soiled portion.

Thus, there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the arrangement of the components set forth in the following description or illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development.

It is important that the claims be regarded as including equivalents resulting therefrom that do not depart from the spirit and scope of the present invention. The application is neither intended to define the invention of the application, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with the accompanying drawings, wherein like characters of reference designate like parts throughout the several views.

DETAILED DESCRIPTION OF THE PREFERRED EMBODIMENT

Figure 1:
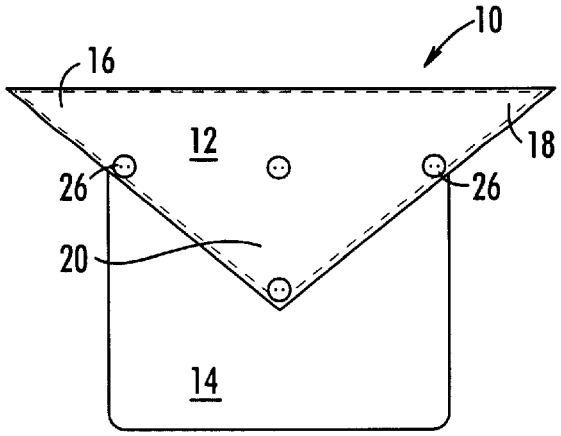
FIG. 1 is a plan view of the interchangeable bib comprising the present invention showing the neck engaging section connected to the body encompassing section by a plurality of buttons.

Referring now to the drawings and particularly to FIG. 1, an interchangeable bib shown generally as 10 includes a neck engaging section 12 and a body encompassing section 14. Neck engaging section 12 takes the form of an isosceles triangle having two upper ends 16, 18, positioned at substantially the same horizontal location. Lower end 20 is lower than upper end 16, 18 and approximately midway between.

Figure 5:
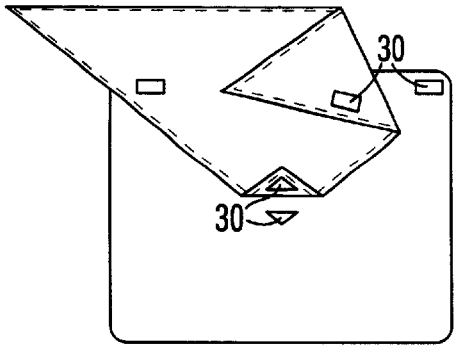
FIG. 5 is a plan view of the interchangeable bib of the present invention similar to that shown in FIG. 4 wherein the two sections are about to be secured by cooperating hook and loop elements.
Figure 4:
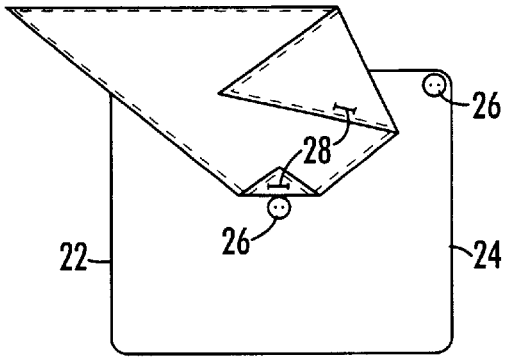
FIG. 4 is a plan view of the neck engaging section and the body encompassing section of the present invention, positioned in alignment with each other and ready to be buttoned to join the two sections together.

Body encompassing section 14 is essentially rectangular in configuration, although it may take other shapes. To provide a symmetrically designed bib, lower end 20 is positioned midway between edges 22 and 24 of section 14 as shown in FIGS. 1, 4 and 5. Section 14 is sufficient in size to provide protection to the wearer over the chest, stomach and lap portions and thereby to prevent stains or soils in the wearer's clothing.

Sections 12 and 14 are joined together by a variety of elements. For example, buttons 26 are used in the embodiments shown in FIGS. 1 and 4, the buttons being affixed to section 14 and buttonholes 28 provided in section 12.

Figure 2:
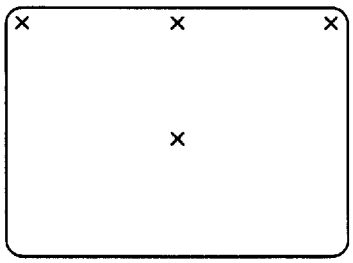
FIG. 2 is a plan view of the body encompassing section marked to receive a plurality of hook or loop elements.
Figure 3:
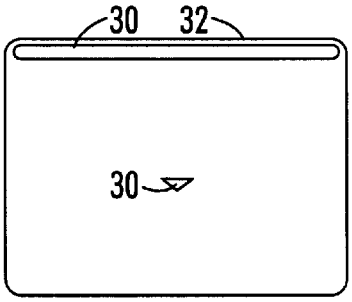
FIG. 3 is a plan view of the body encompassing section wherein hook or loop elements have been applied.

Another embodiment of the securement means for joining sections 12 and 14 is shown in FIGS. 2, 3 and 5, wherein hook and loop elements 30 are strategically located on each of sections 12 and 14. Small segments of elements 30 are shown in FIG. 5 while FIG. 3 illustrates an elongated upper hook or loop element 30 extending across the top 32 of section 14 and a smaller spot element 30 positioned therebelow.

Obviously other securement devices, such as snaps, hooks, adhesives, and the like may be used with equal effectiveness to achieve the objectives of the present invention. All provide an efficient and inexpensive way to replenish a soiled bib or apron or redecorate that same garment if redecoration is desired.

Any number of fabrics may be used for the components of the present invention; however, it is likely to be more advantageous to utilize an absorbent material for the body encompassing section 14.

While preferred embodiments of the invention have been shown and described in detail, it will be apparent to those skilled in the art that various changes and modifications may be made without departing from the basic principles of the invention embraced by the following claims.

What is claimed is:

1. An interchangeable bib changeable in appearance for decorative reasons and replaceable to remove a soiled and install an unsoiled bib, the bib including: a neck engaging section; a body encompassing section secured to the neck engaging section; the neck engaging section having a triangular configuration with two upper ends and a lower end, the two upper ends being joinable to each other upon encircling the neck of a wearer, and the body encompassing section covering and protecting the body of the wearer wherein the body encompassing section is releasably secured to the neck engaging section and the neck engaging section is an isosceles triangle with said two upper ends spaced from each other in a horizontally level position, the lower end having at least one securement means for engaging the body encompassing section at its midpoint, the body encompassing section having complementary securement means to cooperate with the securement means of the neck engaging section.

2. The bib as claimed in claim 1 wherein the two upper ends are tieable to each other.

3. The bib as claimed in claim 1 wherein the securement means is buttons.

4. The bib as claimed in claim 1 wherein the securement means hook and loop fasteners and the body encompassing section is formed of a decorative fabric removable from the neck engaging section for cleaning or for changing to a different decorative fabric to achieve a different appearance.

5. The bib as claimed in claim 1 wherein the securement means is snaps.

* * * * *